US009289017B2

(12) United States Patent
Raven et al.

(10) Patent No.: US 9,289,017 B2
(45) Date of Patent: Mar. 22, 2016

(54) PAD FOR A BRASSIERE CUP

(71) Applicant: CHICO'S BRANDS INVESTMENTS, Fort Myers, FL (US)

(72) Inventors: Glyn Raven, Fort Myers, FL (US); Donna Mines, Fort Myers, FL (US); Michelle Roach, Fort Myers, FL (US); Rosalind Scott, Ilkeston (GB)

(73) Assignee: CHICO'S BRANDS INVESTMENTS, Fort Myers, FL (US)

( * ) Notice: Subject to any disclaimer, the term of this patent is extended or adjusted under 35 U.S.C. 154(b) by 375 days.

(21) Appl. No.: 13/796,464

(22) Filed: Mar. 12, 2013

(65) Prior Publication Data

US 2014/0273738 A1 Sep. 18, 2014

(51) Int. Cl.
*A41C 3/14* (2006.01)

(52) U.S. Cl.
CPC ..... *A41C 3/144* (2013.01)

(58) Field of Classification Search
CPC ..... A41C 3/00; A41C 3/10; A41C 3/144; A41C 3/148; A41C 3/14; A41C 3/142
USPC ..... 450/39, 54–57; 2/267, 268
See application file for complete search history.

(56) References Cited

U.S. PATENT DOCUMENTS

| | | | | |
|---|---|---|---|---|
| 6,997,775 | B2 | 2/2006 | Jagaric et al. | |
| 8,105,130 | B2 | 1/2012 | Fildan et al. | |
| 2004/0142633 | A1 * | 7/2004 | Luk | 450/39 |
| 2005/0020183 | A1 * | 1/2005 | Falla | 450/39 |
| 2005/0208875 | A1 * | 9/2005 | Jagaric et al. | 450/39 |
| 2006/0030238 | A1 * | 2/2006 | Jagaric et al. | 450/57 |
| 2006/0276105 | A1 | 12/2006 | Han | |
| 2007/0298682 | A1 * | 12/2007 | Liu | 450/39 |
| 2008/0090491 | A1 * | 4/2008 | Liu | 450/39 |
| 2008/0153387 | A1 * | 6/2008 | Liu | 450/39 |
| 2008/0153388 | A1 * | 6/2008 | Liu | 450/39 |
| 2009/0181599 | A1 * | 7/2009 | Farmer et al. | 450/39 |
| 2009/0291617 | A1 | 11/2009 | Wong et al. | |
| 2010/0041313 | A1 * | 2/2010 | Castellano | 450/39 |
| 2014/0273738 | A1 * | 9/2014 | Raven et al. | 450/57 |

* cited by examiner

*Primary Examiner* — Gloria Hale
(74) *Attorney, Agent, or Firm* — Grossman, Tucker, Perreault & Pfleger, PLLC

(57) ABSTRACT

A molded pad for a brassiere cup contains shaved polyurethane foam inserts interleaved between thin upper and lower polyurethane foam layers. Three shaved inserts can be used for positioning in the neckline, underarm and center front regions of the pad, with each insert providing a different level of firmness and elongation to the pad. The pad can be made by positioning the shaved inserts in between thin upper and lower polyurethane layers and molding the composite under heat and pressure to form a laminate having a bra cup shape.

24 Claims, 2 Drawing Sheets

PAD FOR A BRASSIERE CUP

BACKGROUND OF THE INVENTION

The present invention relates to a new type of padded brassiere. More particularly, the present invention relates to a molded bra pad having distinct zones, each zone providing an optimum level of support, comfort and fit for a specific region or area of breast tissue. Preferably, the bra pad of the present invention has three distinct zones, an underarm zone, a neckline zone and a center front zone, each of the three zones providing different levels of support and stretchiness for the corresponding breast tissue. The pad of the present invention is used in or as a bra cup of a manufactured padded brassiere.

Previously, bras with varying levels of support combined with minimum bulk and thickness, have been produced using cut panels of fabric having different support and stretch characteristics. In this manner, optimum levels of support and stretchiness can be provided for correct and desirable fit and accommodation of the breast tissue as it is displaced by the semi-rigid areas of the cup. These "cut and sew" bras are supportive, do not add bulk to the breast and fit well, but do not provide the same level of comfort and modesty as a bra with a pad. The present invention relates to a padded bra, especially of the polyurethane pad type, which simulates the support of a cut and sew bra while providing the comfort and coverage of the padded bra type.

The prior art also includes a molded bra cup having a reinforcing pad layer interleaved between upper and lower layers used for forming the molded bra cup. See US 2006/0276105, in which, for improving support, an interleaving pad layer having a predetermined strength is positioned at the lower portion of the pad. This reference also states broadly that the reinforcing pad(s) can be of various shapes depending upon user taste, design and functions. As an example, a reinforcing pad having a higher density and hardness can be positioned toward the front of the breast tissue for increasing breast volume. In another example, a reinforcing pad is placed transversely along the upper portion of the bra cup and is smaller than a lower reinforcing pad positioned along the lower and front portion of the bra cup. These reinforcing pads have a higher density than that of the upper and lower pad cloths used for forming the molded bra cup so as to provide additional support to breast tissue. The interleaved reinforcing pad is not formed of shaved polyurethane foam.

Also, bra pads of graduating thickness are known. For example, US 2009/0291617 describes a bra pad having a generally cup shaped body having a base perimeter, a neckline perimeter and an under arm perimeter, with the thickness of the cup-shaped body gradually tapering from the base perimeter to an apex of the cup shaped body and then to the neckline perimeter. The bra is designed so that any metal under wire is positioned beneath the base perimeter of the bra pad for providing more comfort than that of a standard under wire bra.

Further, the prior art also describes the use of inlays within the fabric cloths of a bra. See U.S. Pat. No. 8,105,130 describing an improved inlay formed of a resilient shape-maintaining plastics material, generally crescent shaped. The inlay of the '130 reference is said to increase the comfort of the bra wearer due to a predetermined thickness providing resilient bending about various axes. Flexural rigidity decreases from a relatively less markedly curved edge that rests against the thorax inwardly toward the breast side edge.

Victoria's Secret markets an IPEX™ bra in which a layer of foam forming the bra pad is manufactured of shaved polyurethane foam. See U.S. Pat. No. 6,997,775; FIGS. 1-3 thereof illustrate a foam shaving process and apparatus, in that case for forming a bra pad having a defined shape.

SUMMARY OF THE INVENTION

It is an object of the present invention to provide an improved molded bra pad possessing and furnishing different degrees of firmness and stretchiness to different areas of the breast tissue.

Thus, another object to the present invention is to provide a bra pad of the molded type characterized by the support and stretchiness of a cut and sew bra while furnishing the comfort and coverage of a padded bra.

Still another object of the present invention is to provide a polyurethane molded bra cup furnishing the varying support of a cut and sew bra cup.

A further object of the present invention is to provide a polyurethane molded bra cup including shaved polyurethane inserts molded into the bra cup and which provide different levels of support, fit and comfort to different regions of the breast without increasing the overall bulk of the bra pad.

Another object of the present invention is to provide a polyurethane molded bra cup including shaved polyurethane inserts, each insert providing, in combination, a different level of elongation and firmness to an area of the manufactured bra cup for furnishing optimum support, comfort and fit to different zones of the breast tissue.

Still a further object of the present invention is to provide a polyurethane molded bra cup including three shaved polyurethane inserts which in the aggregate are coextensive with the entire surface area of the bra cup, with each of the corresponding three zones of the manufactured cup being characterized by a different elongation and firmness for providing optimum fit, comfort and support for that zone of corresponding breast tissue.

Still another object of the present invention is to provide a polyurethane molded bra cup formed of inner and outer polyurethane foam layers of defined density and hardness and containing there between shaved polyurethane inserts characterized by hardness and density different from that of the inner and outer layers for providing optimum breast comfort, support and coverage.

Another object of the present invention is to provide a polyurethane molded bra pad in which the neckline, under arm and center front sections of the cup are characterized by different levels of elongation and firmness.

Still a further object of the present invention is to provide a polyurethane molded bra pad formed of inner and outer polyurethane foam layers obtained by longitudinally slicing in half, depth-wise, a single polyurethane foam sheet of the type and thickness used for forming a molded bra cup for producing two thin polyurethane foam sheets, and positioning there between prior to molding, three polyurethane foam shaved inserts of different density and hardness than that of the single polyurethane foam sheet, with each insert being capable of providing, in combination, a different amount of elongation and firmness to its corresponding area of the manufactured pad, and then molding the layered structure into a composite, laminated molded bra pad. Preferably, in this embodiment of the invention, the three polyurethane shaved inserts in the aggregate are substantially coextensive with the entire surface area of the molded bra pad.

Therefore, in accordance with the present invention, there is provided a molded bra pad as manufactured comprising shaved polyurethane foam inserts of uniform density and hardness throughout their shape, with each shaved insert providing a different level of firmness and elongation to its corresponding section of the manufactured bra pad.

Furthermore, in accordance with the present invention, there is provided a molded bra pad possessing distinct differences in degree of elongation and firmness, in combination, in the neckline, underarm and center front sections of the molded bra pad. In particular, the neckline section of the manufactured bra pad has an elongation of about 20 to 25% and a firmness of about 20 to 25%, the underarm section of the manufactured bra pad has an elongation of about 4.0 to 6.0% and a firmness of about 35 to 40%, and the center front section of the manufactured bra pad has an elongation of about 8.0 to 12.0% and a firmness of about 30 to 40%. More particularly, the molded bra pad of the present invention is formed of polyurethane, and the neckline section of the manufactured bra pad has an elongation of about 20.5% and a firmness of about 25%, the underarm section has an elongation of about 5.7% and a firmness of about 40%, and the center front section has an elongation of about 9.7% and a firmness of about 35%.

More particularly, the present invention provides a polyurethane molded bra cup comprising a molded laminate of thin inner and outer polyurethane sheets and an inner polyurethane layer formed of three distinct shaved polyurethane inserts, each insert providing, in combination, a different degree of elongation and firmness to a section of the molded bra cup coextensive with an individual shaved polyurethane insert. In a preferred embodiment, the polyurethane molded bra cup of the present invention comprises a polyurethane molded composite of the above type in which three shaved inserts form in the aggregate an internal polyurethane layer having a surface area substantially coextensive with that of the inner and outer polyurethane foam sheets. Where desired, more or less than three shaved polyurethane inserts can be used to form the substantially coextensive inner polyurethane layer.

Furthermore, in accordance with the present invention, a method is provided comprising the steps of slicing in half depth-wise a standard polyurethane foam sheet to be used in forming a molded bra pad, separating the two thin polyurethane sheets, positioning shaved polyurethane inserts in between the two thin polyurethane sheets in accordance with predetermined positioning in relationship to the physical properties of the inserts and molding the layered structure into a composite, laminated bra pad. In preferred embodiments of the method invention disclosed herein, the shaved polyurethane inserts are formed in separate shaving molds having shapes and depths for providing inserts of predetermined shape and physical properties, the physical properties being related to the firmness and elongation values found in the molded bra pad.

BRIEF DESCRIPTION OF THE DRAWING

Specific embodiments of the present invention will be described by way of example with reference to the accompanying drawings.

DETAILED DESCRIPTION OF THE INVENTION

Figure 1:
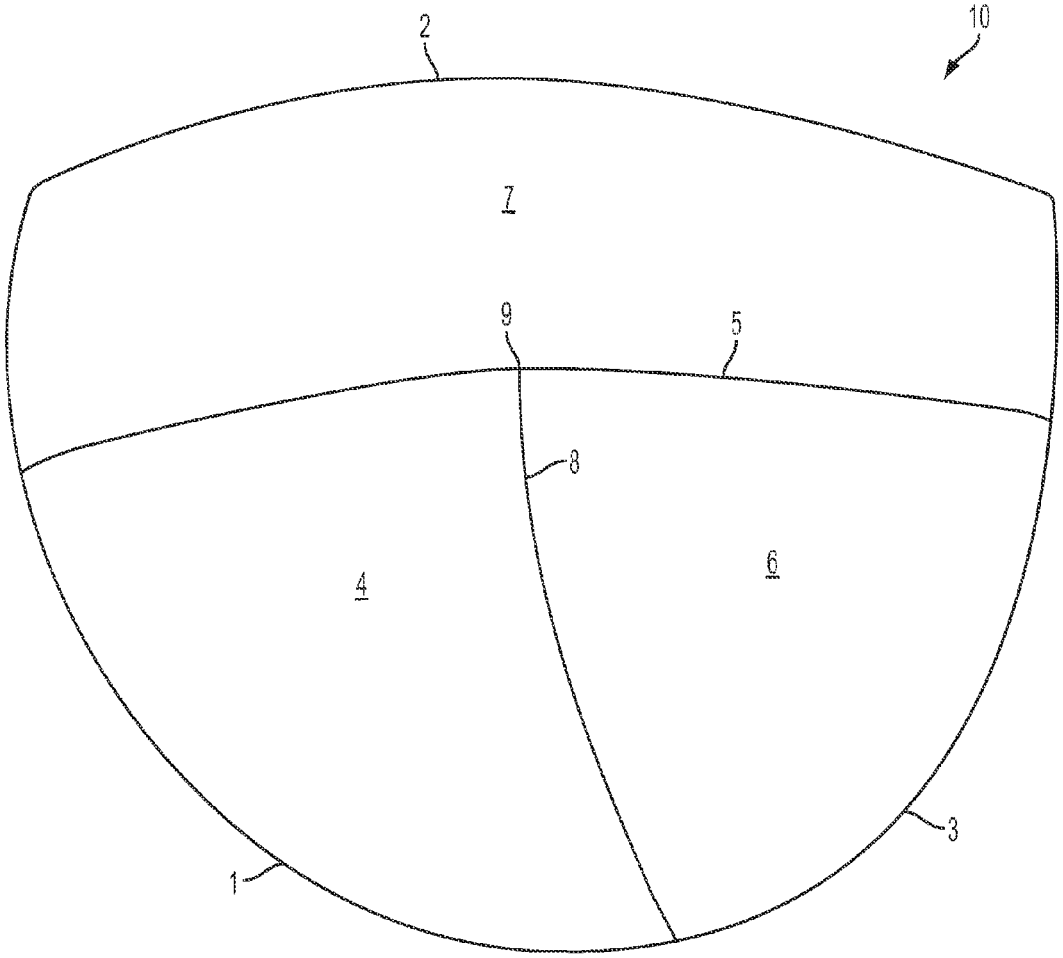
FIG. 1 is a rear view of a bra pad in accordance with the present invention in which as shown the interior sheet of the bra pad has been marked to divide its surface area into three distinct zones of the bra pad.

The bra pad of the present invention is adapted to be incorporated into a bra of the present invention for giving support and contour to the breast of the wearer. The inventive pad, after molding, is generally cup-shaped with an outer convex surface and an inner concave surface. As shown in FIG. 1, the inventive bra pad 10 has a base or center front perimeter 1, a neckline perimeter 2 and an underarm perimeter 3. The center front perimeter is the pad edge that extends generally along the base of a breast of the wearer. The neckline perimeter is the edge of the pad extending generally along or near the neckline of the wearer. The underarm perimeter is the edge of the pad which extends generally under the arm of the wearer.

In its preferred embodiments, the surface area of the bra pad of the instant invention can be divided into three sections, each being adjacent to the center front edge, the neckline edge or the underarm edge of the pad. For illustrative purposes, as below described, the bra pad depicted in FIG. 1 would be positioned within the inventive bra for covering and supporting the right breast of the wearer.

The neckline section of the inventive bra pad extends downwardly from the neckline edge 2 to horizontal demarcation 5 to form a horizontal band 7 extending downwardly about 30 to 40% of the distance from the center of neckline perimeter 1 to the further most point there from at the bottom of the bra cup. Preferably, band 7, which is the neckline section of the bra pad, extends downwardly about ⅓ of the distance to the further most point at the bottom of the pad. This means that if the longest measurement from the center of the neckline perimeter to the base of the cup is about 15 centimeters, that demarcation line 5 is about 5 centimeters from the neckline edge and generally follows the curvature of the neckline edge, although that is not a precise requirement of the present invention. The remainder of the inventive pad is divided by demarcation line 8 into inner and outer zones, the inner zone 4 being the center front area of the pad and the outer zone 6 being the underarm area of the pad. Demarcation 8 roughly divides the remainder of the cup into approximately 2 equal areas, the center front and the underarm areas. Demarcation 8 extends downwardly from approximately the center point 9 of demarcation 5 (the center point is determined by measuring across the cup) to approximately the center point of a radius formed by the cup perimeter extending downwardly between the two ends of demarcation 5. In practice, and as a general guide, demarcation 8 intersects the bottom edge of the cup at about its greatest distance from the center of the demarcation 5, or within up to about 1 to 2 centimeters (as measured along the peripheral edge of the cup) from that center point when it is desired to have one of the center front and underarm surface areas greater than the other. Preferably, the center front area of the cup is about 40 to 50%, preferably about 45% of the surface area below demarcation 5 with the remainder of about 60 to 50%, preferably about 55%, forming the underarm portion of the cup. Preferably, the surface area of the under arm section of the pad is larger than the surface area of the center front section of the pad.

The above-referenced coverage or size proportions provided by the three shaved inserts will remain constant regardless of cup size. The above-noted specific dimensions of 15 and 5 centimeters are approximate for a cup size of 34C. Smaller and larger cup sizes will have different specific measurements while, as noted, the relative size of each insert remains constant regardless of cup size.

One of the distinct advantages of the present invention is provided by the use of shaved polyurethane foam inserts. A shaved insert is characterized by possessing throughout substantially identical firmness, density and elongation values. In this manner, a shaved insert provides uniform physical properties along and within its entire surface area to the manufactured bra pad. If a standard piece of polyurethane foam is used as an insert, the insert, and hence the manufactured bra pad, possesses different degrees of firmness throughout its shape. The employment of shaved inserts allows the manufactured pad to possess approximately uniform physical properties of firmness and elongation (firmness and stretchiness) across the entire area of the bra pad containing the shaved insert.

The manufacture of a shaved insert is known in the art. In general, a layer of polyurethane foam is placed between two plates, one of which contains a depression. The plates are brought together, forcing the foam into the depression. The polyurethane foam becomes more compact at its edges and less compact within the depression. A band knife is then run across and between the mating plates to cut off the foam in the depression. The foam in the depression is the shaved foam insert. Therefore, the shape of the depression will correspond to the shape of the neckline, underarm or center front portion of the cup. The depth of the mold affects the extension or elongation of the shaved insert. A shallower mold provides more extension in the shaved polyurethane foam insert, correlating to more stretchiness and less firmness in a manufactured cup. A deeper mold depression yields a shaved insert containing more foam, producing less stretchiness and more firmness in the insert. Therefore, the neckline insert will be produced using a shallower mold depression than that used in the molds used for the other areas of the cup. Starting with a specific polyurethane foam sheet, the skilled artisan using the normal "shaving" techniques can determine the proper depression depth for obtaining a desired degree of stretchiness or elongation, and firmness in the manufactured pad through routine experimentation.

Once the shaved inserts have been produced as above described, each is placed in between two thin sheets of polyurethane foam in the predetermined locations and the assembly is molded in a standard manner under heat and pressure, for example using a sculpter/sloper molding apparatus and process for forming a composite laminate.

Shaved inserts are selected for providing different degrees of hardness (or softness) and stretchiness to different regions of the cup. In general, a shaved insert is selected for providing softness and stretchiness to the neckline section of the cup. On the other hand, a shaved insert is selected for providing a greater degree of hardness (firmness) and less stretchiness to the center front section of the cup. The underarm section will possess good firmness and a degree of stretchiness in between those above referenced, again with selection of an appropriate shaved insert for providing the desired properties in the manufactured cup.

Figure 2:
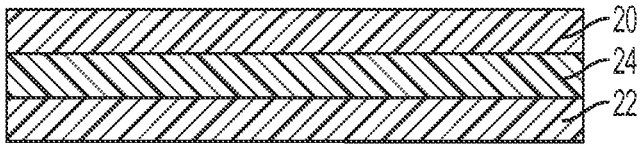
FIG. 2 is a cross-sectional view of a layered structure of the present invention prior to molding.

FIG. 2 depicts the cross-section of the layered structure that is molded into the manufactured cup of the present invention, in which 20 and 22, are inner and outer polyurethane foam layers, respectively, and 24 is a shaved polyurethane foam insert sandwiched in between the inner and outer layers at the neckline section of the pad.

In an exemplified embodiment of the present invention, the polyurethane foam sheet used for the inner and outer layers of the cup has a hardness of 45-60 Asker F and a density of 39-45 $Kg/m^3$. This foam has a thickness of about 10 to 20 mm prior to slicing. Other polyurethane foam sheets which are employed in producing molded bra cups may be employed, and for example, may have an Asker F hardness of about 40 to 65 and a density of about 35 to 50 $Kg/m^3$. In the exemplified embodiment, the polyurethane foam sheet is sliced in half through its depth, forming two thin polyurethane foam sheets of about 5 to 10 mm in thickness.

Again, in an exemplified embodiment, the polyurethane foam used for forming the shaved inserts has a hardness of 67-82 Asker F and a density of 26-32 $Kg/m^3$ and a thickness of 10 to 20 mm. After shaving, inserts are provided which produce varying elongations (or stretchiness) and firmness (or softness) in the noted three areas of the manufactured cup. Elongation percent is tested at 7.5 lb force in accordance with standard elongation testing procedures. The sample is placed in an Instron machine at a fixed distance between grips. Thereafter, the sample is stretched to the predetermined load and allowed to recover to the original setting. A stress/strain curve is generated from which elongation and recovery can be determined. Firmness is tested in accordance with testing protocol ASTM 2240.

In the manufactured (that is, following molding of the layered structure under heat and pressure) bra pad of the instant invention, the neckline area will have an elongation as above determined of about 20 to 25%, preferably about 20.5%; the center front area will have an elongation of about 8.0 to 12.0%, preferably about 9.7% and the underarm area of the cup will have an elongation of about 4.0 to 6.0%, preferably about 5.7%. Also, with reference to the manufactured pad, the neckline area will have a firmness of about 20 to 25%, preferably about 25%; the center front area will have a firmness of about 30 to 40%, preferably about 35% and the underarm area will have a firmness of about 35 to 40%, preferably about 40% firmness.

The polyurethane foam used for forming the inner and outer layers of the laminate is considered to be a high density, low hardness foam, thereby providing a soft touch and adequate comfort. The foam possessing the aforementioned hardness of 45-60 Asker F and density of 39-45 $Kg/m^3$ meets these requirements. On the other hand, the polyurethane foam sheet used for forming the shaved inserts needs to not only provide support in various cup regions but also stretchiness. Therefore, the polyurethane foam selected for forming the shaved inserts will have a higher hardness value, say about 60 to 90, preferably about 67-82 Asker F, and a lower density value, say about 23-35, preferably about 26-32 $Kg/m^3$ than those values of the foam used for forming the inner and outer layers of the laminate. These specific polyurethane foams are used in manufacturing three zone bra pads of the present invention. Hardness and density values remain the same after shaving. In practice, inner and outer surface fabrics, such as micro polyester fabrics, are laminated to the inner and outer polyurethane foam layers, such as with use of glue, prior to molding. The inner side of the inner or outer foam layer will contain indicia showing where the three shaved inserts are to be positioned prior to molding. After positioning of the inserts, the other of the inner or outer foam layer, to which the micro polyester or similar outer decorative fabric has been attached, is placed over the inserts and the composite is molded under heat and pressure for forming the manufactured laminate Glue is placed between the shaved inserts and the two outer polyurethane layers for holding the laminate together for and during molding. The laminate is then cut into final cup shape. In this manner, the bra cup of the present invention provides an underarm area which is the most supportive section of the cup and having low stretchiness but high firmness, thereby preventing the underarm portion of the bust from bulging while upwardly pushing the bust; provides a center front cup area furnishing less support than the underarm area while uplifting the bust to give a push-up effect; and provides a neckline area of the cup that is soft and stretchy for accommodating the capacity of the bust pushed by the other two zones of the pad.

Variations of the invention will be apparent to the skilled artisan and are considered to be within the scope of the present invention and the appended claims. For example, other resilient and formable thermoplastic materials could be used in place of the polyurethane foam sheets.

What is claimed is:

1. A brassiere cup including a neckline perimeter region, an underarm perimeter region and a center front perimeter region when placed on a wearer, comprising:

a molded polyurethane pad including an outer polyurethane layer;

an inner polyurethane layer coextensive with said outer polyurethane layer; and an intermediate layer sandwiched between said inner and outer polyurethane layers, said intermediate layer comprising shaved polyurethane inserts positioned in between the outer and inner polyurethane layers, wherein said shaved polyurethane inserts are formed from a polyurethane foam sheet having a first Asker F hardness in the range of 60 to 90 and a first density in the range of 23-35 Kg/m$^3$ and said shaved polyurethane inserts include a first insert in said neckline perimeter region of the molded pad wherein said neckline perimeter region of the molded pad exhibits a first elongation, a second insert in said underarm perimeter region of the molded pad, wherein said underarm perimeter region exhibits a second elongation, and a third insert in said center front perimeter region of the molded pad, wherein said center front perimeter region exhibits a third elongation, wherein said first elongation is greater than said third elongation and greater than said second elongation, and said second elongation is less than said third elongation, and wherein said cup exhibits an outer convex surface and an inner concave surface.

2. The brassiere cup of claim 1, wherein the intermediate layer is substantially coextensive with the outer and inner polyurethane layers.

3. The brassiere cup of claim 1, wherein the first elongation is in the range of about 20 to 25%; the second elongation is in the range of about 4.0 to 6.0%; and the third elongation is in the range of about 8.0 to 12.0%.

4. The brassiere cup of claim 3 wherein the first elongation is about 20.5%; the second elongation is about 5.7%; and the third elongation is about 9.7%.

5. The brassiere cup of claim 1, wherein the first Asker F hardness of the polyurethane intermediate layer is in the range of 67-82 and the first density is in the range of 26-32 Kg/m$^3$.

6. The brassiere cup of claim 2, wherein the first Asker F hardness of the polyurethane intermediate layer is in the range of 67-82 and the first density is in the range of 26-32 Kg/m$^3$.

7. The brassiere cup of claim 1, wherein each of the outer and inner polyurethane layers exhibit a second Asker F hardness in the range of 45-60 and a second density in the range of 39-45 Kg/m$^3$.

8. The brassiere cup of claim 2, wherein each of the outer and inner polyurethane layers exhibits a second Asker F hardness in the range of 45-60 and a second density of 39-45 Kg/m$^3$.

9. The brassiere cup of claim 1, wherein the outer and inner polyurethane layers are formed by slicing in half depth-wise a single polyurethane sheet.

10. The brassiere cup of claim 2, wherein the outer and inner polyurethane layers are formed by slicing in half depth-wise a single polyurethane sheet.

11. The brassiere cup of claim 1, wherein the outer and inner polyurethane layers each exhibit a thickness in the range of about 5 to 10 mm.

12. The brassiere cup of claim 2, wherein the outer and inner polyurethane layers each exhibit a thickness in the range of about 5 to 10 mm.

13. A process for manufacturing a brassiere pad including a neckline perimeter region, an underarm perimeter region, and a center front perimeter region when placed on a wearer, comprising:

positioning shaved polyurethane inserts in between outer and inner polyurethane layers to form a layered structure, wherein said inserts form an intermediate layer;

molding the layered structure under heat and pressure to form a cup-shaped laminate exhibiting an outer convex surface and an inner concave surface;

and trimming the laminate to form a brassiere pad, wherein the shaved polyurethane inserts are formed from a polyurethane foam sheet having a first Asker F hardness in the range of 60 to 90 and a first density in the range of 23-35 Kg/m$^3$ and the shaved polyurethane inserts include a first insert positioned in said neckline perimeter region, wherein the neckline perimeter region exhibits a first elongation, a second insert positioned in said underarm perimeter region, wherein the underarm perimeter region, wherein the underarm perimeter region exhibits a second elongation, and a third insert positioned in said center front perimeter region, wherein the center front perimeter region exhibits a third elongation, wherein said first elongation is greater than said third elongation and greater than said second elongation, and said second elongation is less than said third elongation.

14. The process of claim 13, in which the outer and inner polyurethane layers are formed by cutting in half depth-wise a single polyurethane sheet.

15. The process of claim 13, wherein the intermediate layer is substantially coextensive with the outer and inner layers after the laminate is trimmed to form a brassiere pad.

16. The process of claim 13, comprising attaching a decorative fabric to each of the outer and inner polyurethane layers prior to positioning said shaved polyurethane inserts between said outer and inner polyurethane layers.

17. The brassiere cup of claim 1, wherein the neckline perimeter region of the molded pad exhibits a first firmness, the underarm perimeter region of the molded pad exhibits a second firmness, and the center front perimeter region of the molded pad exhibits a third firmness, wherein said first firmness is less than said third firmness and said first firmness is less than said second firmness, and said second firmness is greater than said first firmness, and second firmness greater than or equal to said third firmness.

18. The brassiere cup of claim 1, wherein the first firmness in the range of about 20 to 25%; the second firmness in the range of about 35 to 40%; and the third firmness in the range of about 30 to 40%.

19. The brassiere cup of claim 18, wherein the first firmness is about 25%, the second firmness is about 40%, and the third firmness is about 35%.

20. The process for manufacturing a brassiere pad of claim 13, wherein the first elongation is in the range of about 20 to 25%; the second elongation is in the range of about 4.0 to 6.0%; and the third elongation is in the range of about 8.0 to 12.0%.

21. The process for manufacturing a brassiere pad of claim 13, wherein the first elongation is about 20.5%; the second elongation is about 5.7%; and the third elongation is about 9.7%.

22. The process for manufacturing a brassiere pad of claim 13, wherein the neckline perimeter region exhibits a first firmness, the underarm perimeter region exhibits a second firmness, and the center front perimeter region exhibits a third firmness, wherein the first firmness is less than the third firmness, the first firmness is less than the second firmness, the second firmness is greater than the first firmness, and the second firmness is greater than or equal to the third firmness.

23. The process for manufacturing a brassiere pad of claim 22, wherein first firmness is in the range of about 20 to 25%; the second firmness is in the range of about 35 to 40%; and the third firmness is in the range of about 30 to 40%.

24. The process for manufacturing a brassiere pad of claim 22, wherein the first firmness is about 25%, the second firmness is about 40%, and the third firmness is about 35%.

* * * * *